US007841795B2

(12) United States Patent
Huang

(10) Patent No.: US 7,841,795 B2
(45) Date of Patent: Nov. 30, 2010

(54) CLEANING DEVICE

(75) Inventor: Kuan-Di Huang, Taoyuan County (TW)

(73) Assignee: Su-Shan Chen, Sanchong (TW)

( * ) Notice: Subject to any disclaimer, the term of this patent is extended or adjusted under 35 U.S.C. 154(b) by 124 days.

(21) Appl. No.: 12/232,204

(22) Filed: Sep. 12, 2008

(65) Prior Publication Data

US 2009/0255074 A1 Oct. 15, 2009

(30) Foreign Application Priority Data

Apr. 10, 2008 (TW) ..... 97206076 U

(51) Int. Cl.
*B43M 11/02* (2006.01)

(52) U.S. Cl. ..... 401/137; 401/139; 401/195; 401/118; 15/244.1; 15/244.4

(58) Field of Classification Search ..... 401/118, 401/123–125, 137, 139, 208, 261–263, 195; 15/258, 244.1, 244.3, 244.4, 118; 222/173, 222/183, 179.5
See application file for complete search history.

(56) References Cited

U.S. PATENT DOCUMENTS 2,707,292 A * 5/1955 Lustbader ..... 401/139
2,986,762 A * 6/1961 Webb ..... 401/6
D294,989 S * 3/1988 Jinkins ..... D32/45
5,299,876 A * 4/1994 Singarella ..... 401/139
6,022,162 A * 2/2000 Aumuller ..... 401/124
6,082,595 A * 7/2000 Lin ..... 222/192
6,726,016 B2 * 4/2004 Chen ..... 206/581
6,948,874 B2 * 9/2005 Roberson ..... 401/139
7,234,189 B2 * 6/2007 Chen ..... 15/118

* cited by examiner

*Primary Examiner*—Gregory L Huson
*Assistant Examiner*—Keegan Gumbs
(74) *Attorney, Agent, or Firm*—Bacon & Thomas, PLLC

(57) ABSTRACT

A cleaning device comprises a main body having a first side provided with a first opening defining a first accommodating space, and a second side provided with a second opening defining a second accommodating space; a squeezable wiper whose first end penetrates the first opening and is retained in the first accommodating space and whose second end is outside the main body; a shield connected with the first opening so that the second end of the wiper is received in the shield; a cleaning liquid bottle received in the second accommodating space and comprising a nozzle portion having a spraying hole; and a cap having a first side connected with the second opening and provided with a third opening, through which the nozzle portion extends to be received in the cap, and a second side having an aperture communicating with the third accommodating space and corresponding to the spraying hole.

3 Claims, 5 Drawing Sheets

CLEANING DEVICE

FIELD OF THE INVENTION

The present invention relates to a cleaning device, and more particularly to a cleaning device that provides convenient use and storage of a wiper and a cleaning liquid bottle, avoids wasteful use of a cleaning liquid, and prevents a user's hand from making direct contact with the cleaning liquid during a cleaning process.

BACKGROUND OF THE INVENTION

Nowadays, if someone is to clean a certain object, he or she will mostly hold a bottle of cleaning liquid, spray the cleaning liquid onto the object to be cleaned, and wipe the object with a cleaning wiper until the object is clean. Now a cleaning process of a liquid crystal display (LCD) is described for example. After the LCD is sprayed with a cleaning liquid, its user will generally have to hold the LCD with one hand and wipe the LCD with a wiper in the other hand during the cleaning process because the LCD is relatively light-weighted and tends to move in response to the user's wipe. To thoroughly clean the LCD, the user may have to fetch the cleaning liquid bottle again and again for spraying the cleaning liquid for some more times, so the cleaning liquid bottle is preferably placed close to the user. However, under such circumstances, the user must be very careful during the cleaning process not to tip the cleaning liquid bottle over, so as to avoid making a mess in the working environment. This causes great inconvenience to the user who is trying to clean the LCD. Besides, it is quite vexing having to look for the cleaning liquid bottle again and again. Furthermore, during the foregoing cleaning process, the cleaning liquid will permeate into the wiper while the user wipes with the wiper, thereby allowing chemicals in the cleaning liquid to make direct contact with or even injure the skin of the user's hand. Moreover, since the cleaning liquid bottle and the wiper come independently, they are usually put aside separately after use. Therefore, when the next time the user wants to do the cleaning, he or she will have to spend time and effort to search for the cleaning liquid bottle and the wiper respectively.

Hence, a cleaning liquid bottle having a wiping function was developed, as shown in FIG. 1, which comprises a cleaning liquid bottle 10, a fixing plate 12, a wiper 14 and a shield 16. The cleaning liquid bottle 10 has an end formed with a bottleneck 101, which is provided centrally with an opening 102 for allowing a cleaning liquid in the cleaning liquid bottle 10 to flow out. The fixing plate 12 is fixed on the bottleneck 101 and provided with a liquid-guiding plug 120 at a location corresponding to the opening 102, wherein the liquid-guiding plug 120 has a plurality of fine pores for allowing the cleaning liquid to pass through the liquid-guiding plug 120. In addition, the fixing plate 12 is provided with two fixing tabs 122 on a side thereof facing away from the cleaning liquid bottle 10, wherein the fixing tabs 122 are located adjacent to a periphery of the liquid-guiding plug 120. The wiper 14 is made of a foam material and formed with two slits 140, which are inserted by the two fixing tabs 122, respectively, when the wiper 14 is assembled to the side of the fixing plate 12, thereby securing the wiper 14 to the fixing plate 12. Thus, if the user wants to clean the LCD with this cleaning liquid bottle having the wiping function, he or she can squeeze the cleaning liquid bottle 10 directly to force the cleaning liquid in the cleaning liquid bottle 10 to flow through the opening 102 and the liquid-guiding plug 120 sequentially and then permeate the wiper 14, so that the wiper 14 can be used to wipe the LCD. When the cleaning is done, the wiper 14 can be covered by the shield 16 to facilitate storage. Unfortunately, however, before the wiper 14 is used for cleaning, the cleaning liquid must permeate from a side of the wiper 14 that is adjacent to the fixing plate 12 to the other side of the wiper 14, and during the permeating process, the cleaning liquid will diffuse gradually into the entire wiper 14, so that an excessive amount of the cleaning liquid may be wasted. Furthermore, during the cleaning process, the user tends to keep exerting a force on and thereby squeezing the cleaning liquid bottle 10 unintentionally, causing the cleaning liquid to flow out of the cleaning liquid bottle 10 continuously during the cleaning process. As a result, an excessive amount of residual cleaning liquid is left on the LCD, which not only prolongs a subsequent air-dry process of the LCD, but the LCD may also be polluted again by dust in the air, thereby compromising the cleaning effect.

As described above, both the conventional cleaning wiper and the foregoing cleaning liquid bottle having the wiping function have drawbacks that lower the user's cleaning efficiency. Therefore, it is an important issue for relevant designers and manufactures to design and produce a cleaning device that can solve the above-mentioned problems.

BRIEF SUMMARY OF THE INVENTION

In view of the shortcomings of the traditional cleaning devices such as inconvenience of use, difficulty in storage and a wasteful use of cleaning liquid, the present inventor, after painstaking research and experiments, finally succeeded in developing a cleaning device as disclosed herein, with the aims of effectively solving the aforementioned problems.

A first objective of the present invention is to provide a cleaning device comprising a main body, a wiper, a shield, a cleaning liquid bottle and a cap. The main body has a first side provided with a first opening that extends into the main body to form a first accommodating space. The main body further has a second side that is adjacent to the first opening and provided with a second opening extending into the main body to form a second accommodating space. The wiper can be squeezed so that a first end thereof extends through the first opening and is retained in the first accommodating space, while a second end thereof is exposed outside the main body. In addition, the first opening can be connected with a side of the shield, so that the second end of the wiper is received in a receiving cavity of the shield and completely covered by the shied. Further, the cleaning liquid bottle is received in the second accommodating space and comprises a bottle body and a nozzle portion that is connected to the bottle body and can be pressed, wherein the bottle body can be filled with a cleaning liquid, and the nozzle portion has a spraying hole for spraying out the cleaning liquid in the bottle body. The second opening can be connected with a first side of the cap, wherein the first side of the cap is provided with a third opening, through which the nozzle portion extends to be received in a third accommodating space formed in the cap. The cap further has a second side that is adjacent to the third opening and formed with an aperture, which is in communication with the third accommodating space and corresponds to the spraying hole of the nozzle portion. Moreover, the cap can be moved up and down in the second accommodating space. Therefore, when using the cleaning device for cleaning, a user only has to direct the aperture towards an object to be cleaned and then press the cap. The nozzle portion will spray the cleaning liquid in the bottle body through the spraying hole onto the object, which can then be wiped with the wiper. When the cleaning is done, the shield can be used to cover the wiper. Thus, the cleaning device provides greatly enhanced convenience of use.

A second objective of the present invention is to provide the cleaning device described above, wherein the main body further has a fourth opening that is located corresponding to the second opening and can be connected with a transparent supporting base for accommodating the bottle body of the cleaning liquid bottle, thereby allowing the user to see into the cleaning liquid bottle through the supporting base and determine whether or not the cleaning liquid bottle should be replaced or refilled with more cleaning liquid.

A third objective of the present invention is to provide the cleaning device described above, wherein the wiper and the cleaning liquid bottle are both contained in the main body so as to be stored in the cleaning device as a whole. Therefore, it is no more necessary for the user to look for the cleaning liquid bottle during the cleaning process, or to worry about tipping over the cleaning liquid bottle by accident and messing up the environment during the cleaning process. Besides, the cleaning liquid bottle of the present invention allows the user to perform single-handedly the actions of spraying the cleaning liquid and wiping. Furthermore, the cleaning liquid is sprayed directly onto the object to be cleaned and therefore less likely to be wasted unknowingly. In addition, the first end of the wiper is received in the main body to prevent the user's hand from making direct contact with the cleaning liquid during the cleaning process, thereby effectively increasing the cleaning quality and efficiency.

BRIEF DESCRIPTION OF THE SEVERAL VIEWS OF THE DRAWINGS

The invention as well as a preferred mode of use, further objectives and advantages thereof, will best be understood by reference to the following detailed description of illustrative embodiments when read in conjunction with the accompanying drawings, wherein.

DETAILED DESCRIPTION OF THE INVENTION

Figure 1:
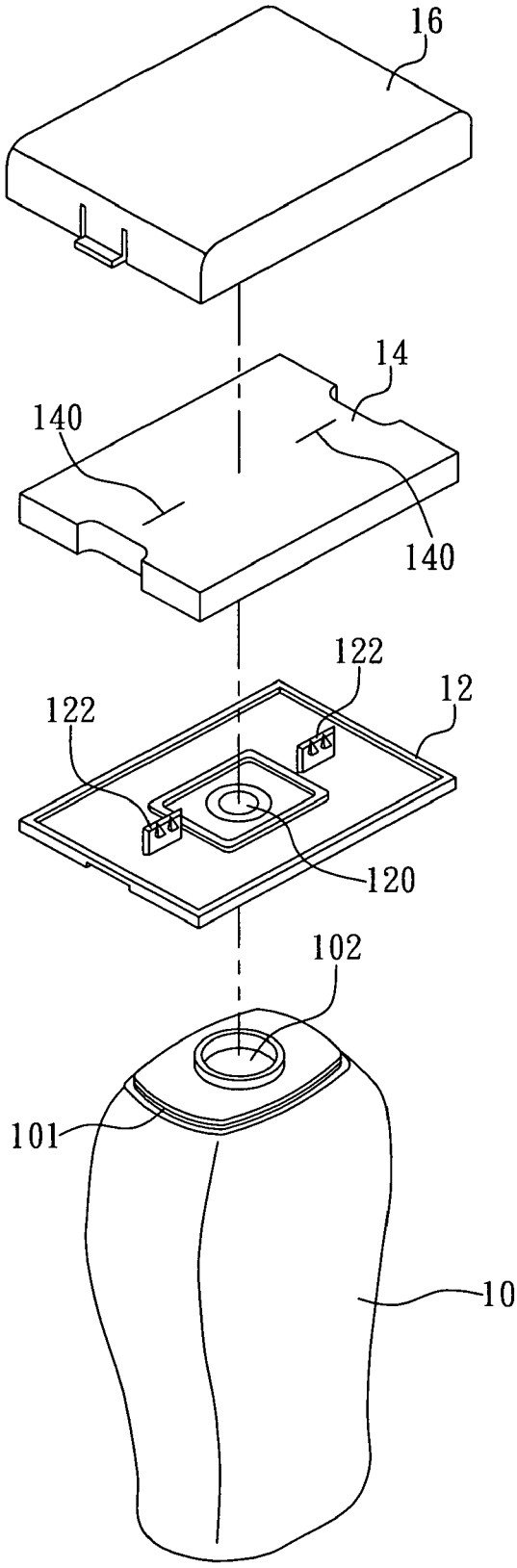
FIG. 1 (Prior Art)
FIG. 1 is a perspective exploded view of a conventional cleaning liquid bottle having a wiping function.
Figure 2:
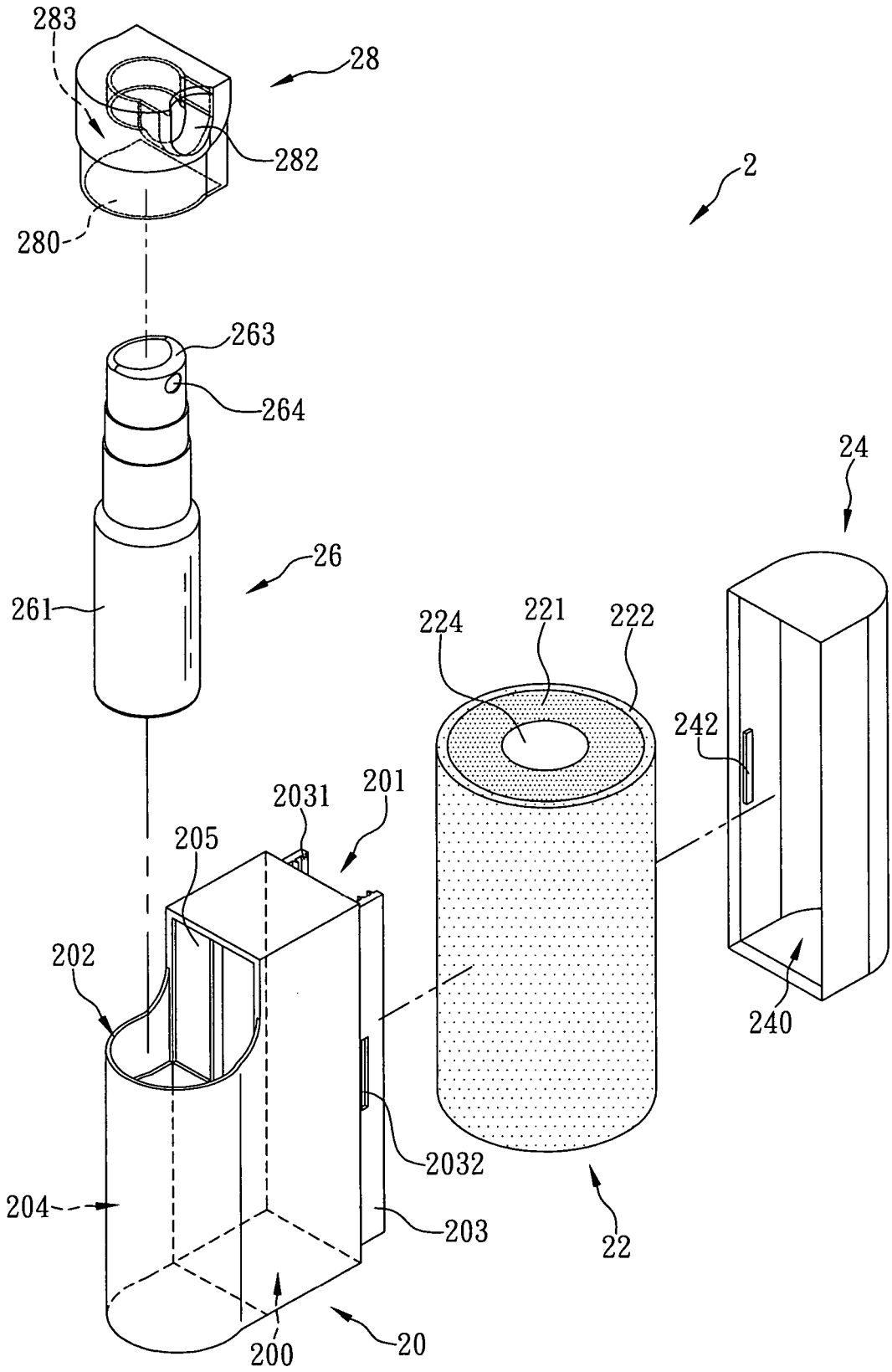
FIG. 2 is a perspective exploded view of a cleaning device according to a first preferred embodiment of the present invention.

The present invention provides a cleaning device for removing dirt from a surface of an object. In a first preferred embodiment of the present invention as shown in FIG. 2, a cleaning device 2 comprises a main body 20, a wiper 22, a shield 24, a cleaning liquid bottle 26 and a cap 28. The main body 20 has a first side provided with a first opening 201. A first accommodating space 200 is formed in the main body 20 at a location corresponding to the first opening 201. The first opening 201 has two opposite edges, each provided with a clamping strip 203 extending away from the main body 20, wherein each of the two clamping strips 203 has an inner surface formed with two ridges 2031. In other embodiments of the present invention, however, the number of the ridges 2031 on each of the clamping strips 203 is not limited to two and can be at least one. In addition, each of the two clamping strips 203 has an outer surface formed with an insertion hole 2032 at corresponding locations. (FIG. 2 only shows one of the insertion holes 2032.) The main body 20 further has a second side that is adjacent to the first opening 201 and provided with a second opening 202, wherein the second opening 202 extends into the main body 20 to form a second accommodating space 204. The first accommodating space 200 and the second accommodating space 204 are separated by a partition wall 205 so that the first and second accommodating spaces 200, 204 are not in communication with each other. However, in other embodiments of the present invention, the partition wall 205 between the first and second accommodating spaces 200, 204 may be omitted to meet a manufacturer's cost requirements or production procedures, so that the first and second accommodating spaces 200, 204 are in communication with each other. The wiper 22 is a resilient foam product and comprises a foam layer 221 and a sponge layer 222 covering an outer periphery of the foam layer 221 so as not to leave scratches on a delicate surface wiped thereby, such as the surface of a mirror. In addition, the wiper 22 can be squeezed so that a first end thereof extends through the first opening 201 and is retained in the first accommodating space 200 and clamped by the ridges 2031 on the two clamping strips 203, while a second end of the wiper 22 is exposed outside the main body 20 and can be used for cleaning. The shield 24 has a side provided with a receiving cavity 240 that has an opening formed with two insertion blocks 242 on opposite edges thereof, respectively. When the side of the shield 24 is connected with the first opening 201, the two insertion blocks 242 are inserted into the two insertion holes 2032, respectively, thereby securing the shield 24 to the main body 20 while allowing the second end of the wiper 22 to be received in the receiving cavity 240. Therefore, the shield 24 can be used to cover the second end of the wiper 22 completely when a cleaning process is finished, thereby preventing the wiper 22 from being polluted by dust in the air when the cleaning device 2 is stored away. Otherwise, the wiper 22 may fail to remove all the dirt on an object to be cleaned and only produce a less than satisfactory cleaning result next time the cleaning device 2 is used.

Figure 3:
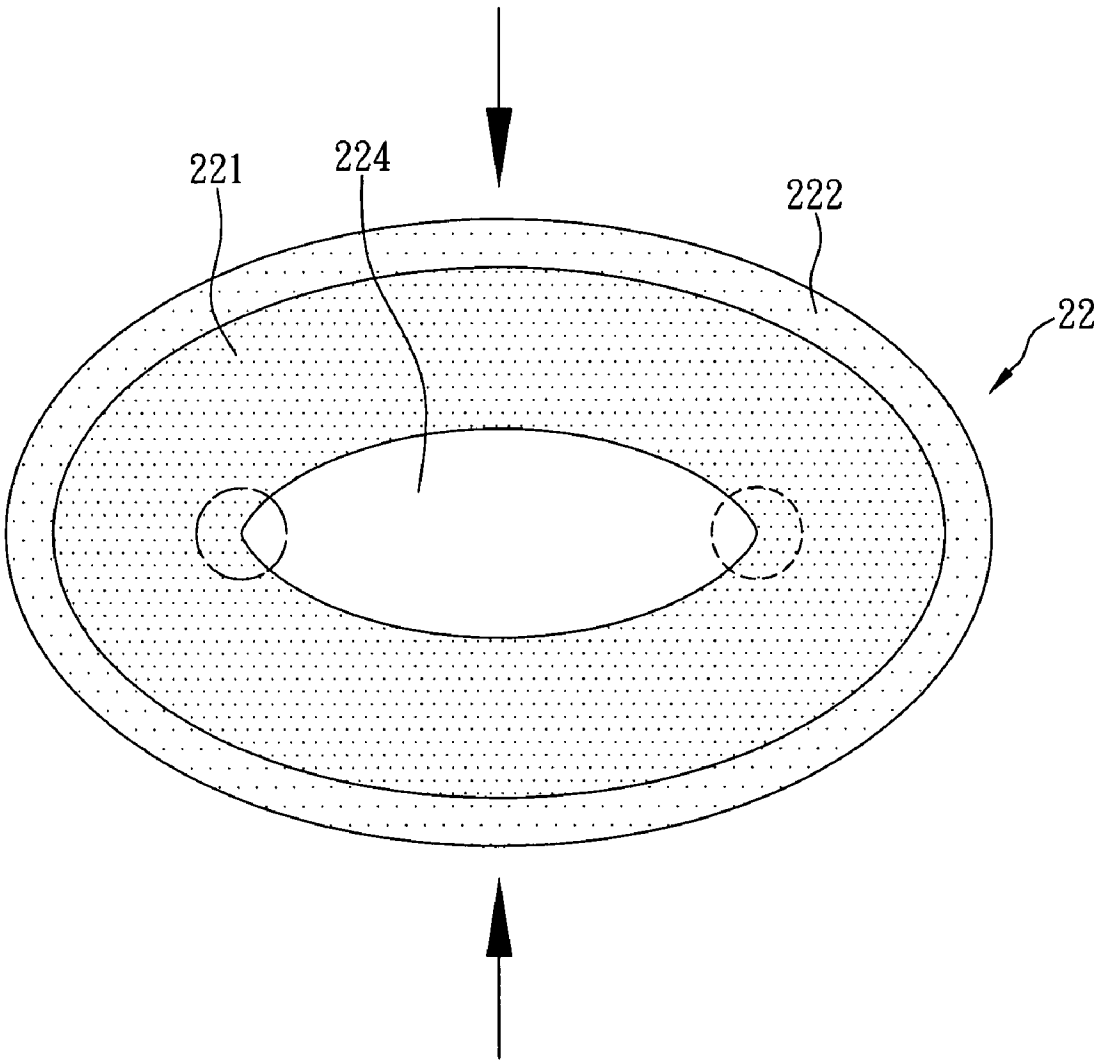
FIG. 3 is a schematic drawing showing deformation of a wiper of the cleaning device according to the first preferred embodiment of the present invention.

Referring to FIGS. 2 and 3, in the first preferred embodiment of the present invention, the wiper 22 has a circular cross-section and a through hole 224 formed centrally therein along a longitudinal axis of the wiper 22. When the wiper 22 is squeezed and deformed (as indicated by arrows in FIG. 3), the through hole 224 provides a deformation space so that a stress applied to the entire wiper 22 is distributed more uniformly, wherein only two lateral sides of the through hole 224 (indicated by dashed-line circles in FIG. 3) are subject to a greater portion of the stress. As a result, the wiper 22 is less susceptible to permanent deformation and can maintain a recovery force that allows the wiper 22 to be tightly clamped by the two clamping strips 203 after long-term use, instead of getting loose due to deformation. In addition, when the exposed portion of the wiper 22 is dirty, the wiper 22 can be taken out, turned around and put back in place, so that a clean portion of the wiper 22 is exposed outside the main body 20, thereby increasing a service life of the wiper 22. However, in other embodiments of the present invention, the wiper 22 can come without the through hole 224 due to cost considerations or a simplified production process of the manufacturer. Besides, the wiper 22 can have other cross-sectional shapes such as a rectangular shape, a wavy shape, etc, without being limited to the circular shape demonstrated herein.

Figure 4:
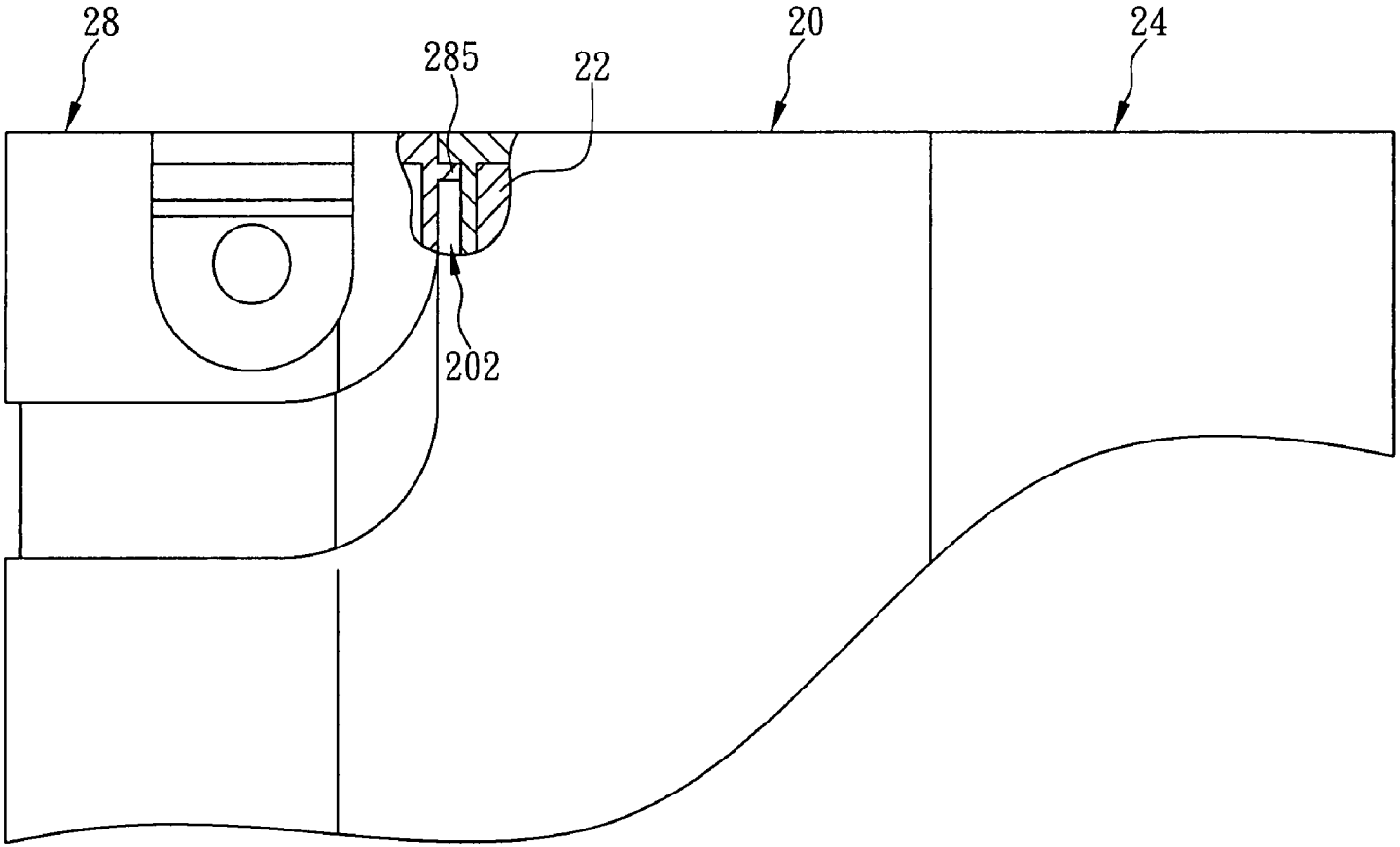
FIG. 4 is a partial cross-sectional view of the cleaning device according to the first preferred embodiment of the present invention.

Referring back to FIG. 2, the cleaning liquid bottle 26 comprises a bottle body 261 and a nozzle portion 263 that can be pressed and is connected with the bottle body 261, wherein the bottle body 261 can be filled with a cleaning liquid and the nozzle portion 263 is provided with a spraying hole 264. When the nozzle portion 263 is pressed, the cleaning liquid in the bottle body 261 will be sprayed out through the spraying hole 264. The bottle body 261 of the cleaning liquid bottle 26 can extend through the second opening 202 and be received in the second accommodating space 204, so that the nozzle portion 263 is exposed outside the main body 20 and will not be obstructed by the main body 20 when spraying the cleaning liquid. The cap 28 has a first side provided with a third opening 280, and a second side that is adjacent to the third opening 280 and formed with an aperture 282. The cap 28 is further formed with a third accommodating space 283 in communication with the third opening 280 and the aperture 282. As shown in FIGS. 2 and 4, the cap 28 further has a third side that is adjacent to the third opening 280 and the aperture 282 and provided with a retaining rib 285. When the first side of the cap 28 is connected with the second opening 202 of the main body 20, the first side of the cap 28 can be moved up and down in the second accommodating space 204, while the nozzle portion 263 of the cleaning liquid bottle 26 extends through the third opening 280 and is received in the third accommodating space 283, with the spraying hole 264 in alignment with the aperture 282. Thus, the user can press the nozzle portion 263 by pressing on the cap 28, so that the cleaning liquid in the bottle body 261 is sprayed out through the spraying hole 264 and the aperture 282 sequentially. When the nozzle portion 263 is not pressed, the retaining rib 285 of the cap 28 will press against a peripheral edge of the second opening 202 on the main body 20, thereby retaining the cap 28 to the main body 20 and preventing such awkward situations as the cap 28 falling out of the main body 20 when the cleaning device 2 is not held upright.

Therefore, when the cleaning device 2 is used for cleaning, the user only has to direct the aperture 282 towards an object to be cleaned and then press the cap 28, thereby driving the nozzle portion 263 to spray the cleaning liquid in the bottle body 261 through the spraying hole 264 and onto the object, which can then be wiped conveniently with the wiper 22. As the cleaning liquid is sprayed directly on the object, wasteful use of the cleaning liquid can be prevented, and there will be no excessive cleaning liquid left on the object that prolongs a subsequent air-dry process. Furthermore, by holding the main body 20, rather than the wiper 22, during the cleaning process, the user is protected from directly exposing the skin of his or her hand to the cleaning liquid, thereby effectively increasing the cleaning efficiency and safety. When the cleaning device 2 is no longer in use, the wiper 22 can be covered by the shield 24 to avoid pollution by dust in the air during storage, or otherwise the wiper 22 will be unable to provide the desired cleaning effect next time the cleaning device 2 is used.

Figure 5:
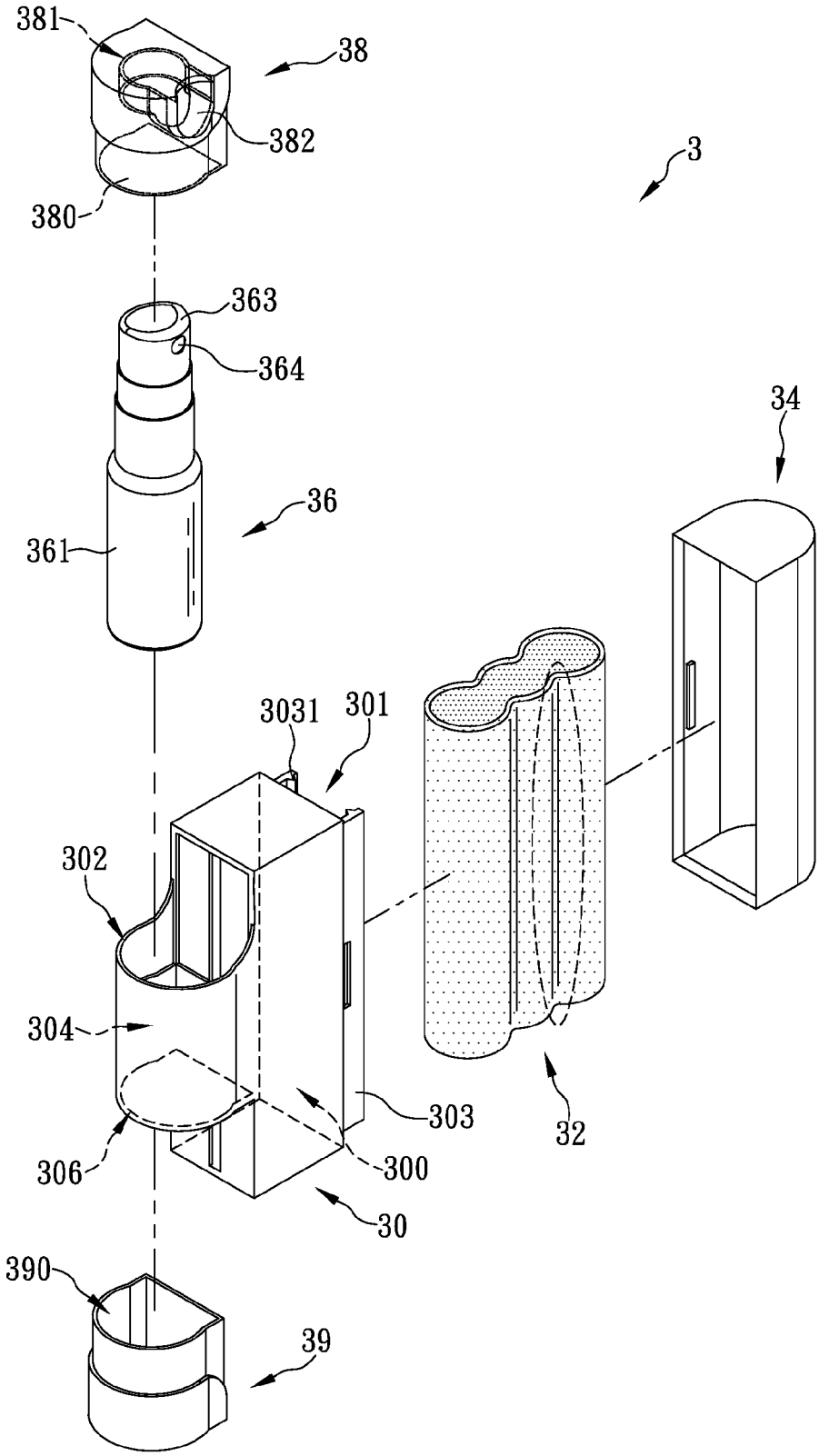
FIG. 5 is a perspective exploded view of a cleaning device according to a second preferred embodiment of the present invention.

Referring to FIG. 5, a cleaning device 3 according to a second preferred embodiment of the present invention comprises a main body 30, a wiper 32, a shield 34, a cleaning liquid bottle 36, a cap 38 and a supporting base 39. The main body 30 has a first side provided with a first opening 301, whose two opposite edges are formed respectively with two clamping strips 303 extending away from the main body 30. The first opening 301 extends into the main body 30 to form a first accommodating space 300. Each of the two clamping strips 303 has an inner surface formed with a ridge 3031, so that a first end of the wiper 32 extending through the first opening 301 and received in the main body 30 is clamped by the two clamping strips 303, while a second end of the wiper 32 is exposed outside the main body 30. As the wiper 32 has a wavy cross-sectional shape, the two ridges 3031 will be located at recessed portions (indicated by a dashed-line oval in FIG. 5) of the wiper 32 when the first end of the wiper 32 is disposed in the main body 30. Therefore, portions of the wiper 32 that are in contact with the two ridges 3031 will be subject to a smaller stress. This not only prevents the wiper 32 from being permanently deformed by prolonged clamping, but also allows the wiper 32 to maintain a higher recovery force. Besides, portions of the wiper 32 that are adjacent to the recessed portions will be retained by the two ridges 3031 and will not easily fall off during the cleaning process. Moreover, when the exposed portion of the wiper 32 is dirty, the wiper 32 can be taken out, turned around and then put back in place, allowing a clean portion of the wiper 32 to be exposed, thereby increasing a service life of the wiper 32. Meanwhile, the main body 30 has a first side that can be connected with a side of the shield 34, so that the second end of the wiper 32 is received in and covered by the shield 34. The main body 30 further has a second side that is adjacent to the first opening 301 and provided with a second opening 302, which allows the cleaning liquid bottle 36 to pass through and then be received in the main body 30. The second opening 302 extends into the main body 30 to form a second accommodating space 304. In addition, the second opening 302 can be connected with a first side of the cap 38, allowing a nozzle portion 363 of the cleaning liquid bottle 36 to be received in the cap 38, wherein the first side of the cap 38 is provided with a third opening 380 for allowing the nozzle portion 363 to pass through. The cap 38 further has a fourth side that is facing away from the third opening 380 and formed interiorly with a C-shaped retaining curve 381. When the nozzle portion 363 is received in the cap 38, the nozzle portion 363 will be surrounded by the retaining curve 381, which has a notch in communication with an aperture 382 formed on a second side of the cap 38, so that a spraying hole 364 on the nozzle portion 363 can be accurately aligned with the aperture 382 and will not deviate from the aperture 382 when the main body 30 is shaken. Moreover, the main body 30 is provided with a fourth opening 306 located corresponding to the second opening 302, for being connected with a side of the supporting base 39, wherein the side of the supporting base 39 is provided with a cavity 390 for receiving a bottle body 361 of the cleaning liquid bottle 36. The supporting base 39 is made of a transparent material, thereby allowing the user to see through the supporting base 39 and check out a remaining amount of the cleaning liquid in the cleaning liquid bottle 36, so that the cleaning liquid bottle 36 can be replaced or filled with more cleaning liquid.

In summary, with the cleaning device according to the present invention, there is no need to waste time in looking for the cleaning liquid bottle or the wiper. Besides, the cleaning liquid will not be wasted because, during the cleaning process, the cleaning liquid is sprayed directly onto the object to be cleaned, rather than having to permeate into the wiper before the wiper can be used for cleaning. In addition, when the cleaning device is no longer in use, the shield can be used to cover the wiper for easy storage, and to prevent the wiper from being polluted by dust in the air. Thus, the cleaning device according to the present invention provides service as a better alternative to existing cleaning devices.

What is claimed is:

1. A cleaning device, comprising:

a main body, having a first side provided with a first opening that extends into the main body to form a first accommodating space, a second side that is adjacent to the first opening and provided with a second opening, wherein the first opening has two opposite edges each formed with a clamping strip extending away from the main body, each of the two clamping strips has an inner surface formed with at least one ridge and an outer surface formed with an insertion hole at corresponding locations, and the second opening extends into the main body to form a second accommodating space;

a wiper including a foam layer and a sponge layer covering an outer periphery of the foam layer, wherein the wiper is squeezable while a first end thereof is retained in the first accommodating space and a second end thereof is exposed outside the main body, and the foam layer of the wiper has a through hole formed centrally therein along a longitudinal axis thereof;

a shield, having a side that is provided with a receiving cavity and, when being connected with the first opening, allows the second end of the wiper to be received therein and completely covered thereby, wherein the receiving cavity of the shield has an opening formed with two corresponding insertion blocks on edges thereof for being engaged with the two insertion holes, respectively;

a cleaning liquid bottle, received in the second accommodating space through the second opening, wherein the cleaning liquid bottle comprises a bottle body that is filled with cleaning liquid, and a nozzle portion that is connected with the bottle body to be pressed, in which the nozzle portion is provided with a spraying hole for spraying out the cleaning liquid in the bottle body; and a cap, having a first side provided with a third opening, and a second side that is adjacent to the third opening and provided with an aperture, said cap being formed with a third accommodating space that is located corresponding to the third opening and in communication with the aperture, the first side of the cap being connected with the second opening of the main body and moved up and down in the second accommodating space, and the nozzle portion of the cleaning liquid bottle extending through the third opening and being received in the third accommodating space while the spraying hole is aligned with the aperture.

2. The cleaning device as claimed in claim 1, wherein the cap has a third side that is adjacent to the third opening and the aperture and provided with a retaining rib, which is engaged with a peripheral edge of the second opening of the main body when the nozzle portion is not pressed.

3. The cleaning device as claimed in claim 2, wherein the cap has a fourth side that is facing away from the third opening and provided interiorly with a C-shaped retaining curve, so that the nozzle portion is surrounded by the retaining curve when the nozzle portion is received in the cap, in which the retaining curve has a notch in communication with the aperture of the cap.

* * * * *